US006345724B1

(12) United States Patent
Masumoto et al.

(10) Patent No.: US 6,345,724 B1
(45) Date of Patent: Feb. 12, 2002

(54) CRANE APPARATUS

(75) Inventors: Masanori Masumoto; Hisanori Abiru; Tetsuo Ichikizaki; Takashi Chikura; Tatsuya Hirano; Shinichi Masumoto; Ikko Yasunaga; Takashi Okada, all of Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/630,457

(22) Filed: Aug. 2, 2000

(30) Foreign Application Priority Data

Aug. 12, 1999 (JP) ..... 11-228185
Jan. 12, 2000 (JP) ..... 2000-03259

(51) Int. Cl.[7] ..... B66C 23/38
(52) U.S. Cl. ..... 212/173; 212/312; 212/320
(58) Field of Search ..... 212/274, 312, 212/320, 321, 322, 323, 173

(56) References Cited

U.S. PATENT DOCUMENTS 3,921,816 A * 11/1975 Madsen ..... 212/312
5,440,476 A * 8/1995 Lefkowitz et al. ..... 212/76
5,626,247 A * 5/1997 Hakala et al. ..... 212/322
6,023,862 A * 2/2000 Sirjola ..... 212/320
6,250,486 B1 * 6/2001 Enoki ..... 212/322

FOREIGN PATENT DOCUMENTS

DE 3813784 A1 11/1988
WO 99/28230 A1 6/1910

* cited by examiner

*Primary Examiner*—Thomas J. Brahan

(57) ABSTRACT

A crane apparatus is disclosed. A hoisting accessory is traversed by rotating rotating drums by driving of a traversing motor to take up or pay out wire ropes. Continuously variable transmissions are provided for changing rotational speeds of the rotating drums. A control device controls the continuously variable transmissions in a gear changing manner so that forces imposed on the drums by the wire ropes will be balanced. Thus, torques acting on the pair of drums are canceled out in all areas in which the hoisting accessory moves, whereby the capacity of the drive motor can be reduced.

7 Claims, 3 Drawing Sheets

CRANE APPARATUS

BACKGROUND OF THE INVENTION

1. Field of the Invention

The present invention relates to a crane apparatus which is used, for example, as a transfer crane of port cargo handling equipment.

2. Description of the Related Art

A conventional transfer crane has a gate-shaped body frame, which can travel by a plurality of traveling wheels. On the top of the body frame, a trolley can move transversely. On the trolley, a rotationally drivable takeup drum is borne. A hoisting accessory is attached to the lower end of a plurality of load suspending wire ropes wound off from the takeup drum. Thus, as the trolley moves on the body frame, a suspended load held by the hoisting accessory can be traversed. When the takeup drum is rotationally driven at a predetermined stop position of the trolley to take up or pay out the plural wire ropes, the suspended load can be moved upwards or downwards.

With the above-described conventional crane apparatus, rails are provided on transverse girders placed on the body frame, and the trolley is supported on the rails. In consideration of the weight of the rails, the weight of the trolley, or the weight of the suspended load imposed on the hoisting accessory, not only the transverse girders and the body frame, but also the entire crane apparatus must have great rigidity, inducing a large size and a heavy weight. When the trolley is moved laterally and stopped at a predetermined position, with the suspended load being held by the hoisting accessory, sway occurs in the hoisting accessory and the suspended load owing to an inertial force working in the lateral direction. This sway does not settle quickly. To prevent sway of the hoisting accessory and the suspended load when the trolley stops, the trolley has to be moved at a slow speed. Since a long time is required for work, the work efficiency is low.

Under these circumstances, the applicant filed an application entitled "Crane System" as International Application PCT/JP98/05448. In the "Crane System", wire ropes are passed over two sheaves provided at a distance in a right-and-left direction on a hoisting accessory; an end of one of the wire ropes is passed over a first drum, and the other end of the one wire rope is passed over a second drum; an end of the other wire rope is passed over the first drum, and the other end of the other wire rope is passed over the second drum; the drums are rotated by a hoisting/lowering motor via a rotation control device in a direction in which the wire ropes are simultaneously taken up or paid out, to enable the hoisting accessory to be hoisted or lowered; and the drums are rotated by a traversing motor via the rotation control device in a direction in which one of the wire ropes is taken up, while the other wire rope is paid out, to enable the hoisting accessory to be traversed. Thus, there is no need to provide rails and a trolley on the body frame. Since the weight on the body frame is reduced, the crane system can be made compact and light-weight. Besides, the hoisting accessory is supported by the wire ropes at the two separated points. Hence, sway of the hoisting accessory and the suspended load due to their inertial force is suppressed, and the work efficiency is increased. Furthermore, the weight of the hoisting accessory and the suspended load is shared between the two drums, so that the hoisting/lowering motor and the traversing motor can be reduced in capacity.

When the hoisting accessory is to be traversed in the foregoing conventional "crane system", the drums are rotated by the traversing motor in the direction in which to pay out one of the wire ropes and take up the other wire rope. In this case, when the hoisting accessory (suspended load) is situated in a central portion in the right-and-left direction of the body frame, the lengths of the respective wire ropes from the hoisting accessory to right-hand and left-hand sheaves are the same. Thus, tensions acting on the respective wire ropes, namely, reaction forces acting on the respective drums, are the same. When the hoisting accessory (suspended load) is moved leftward or rightward relative to the body frame, the lengths of the respective wire ropes change. Thus, a difference in tension occurs between the respective wire ropes, and the reaction forces acting on the respective drums vary. As a result, the traversing motor requires a varying driving force according to the traversing position of the hoisting accessory. Consequently, the capacity of the traversing motor cannot be made sufficiently low. During traversal of the hoisting accessory (suspended load), for example, its movement from left to right in the body frame, rotation of the respective drums by the traversing motor alone results in a downwardly arcuate moving path of the hoisting accessory, because the takeup amount and the payout amount of the right and left wire ropes are the same. To avoid this situation, the hoisting/lowering motor is driven by an amount corresponding to the downward motion of the hoisting accessory to lift the hoisting accessory, thereby moving the hoisting accessory horizontally. As noted from this action, both the traversing motor and the hoisting/lowering motor have to be driven during traversal of the hoisting accessory. Thus, the capacity of each motor cannot be made sufficiently low, either.

With the above-mentioned "crane system", each drum is shaped like a cone so as to minimize a moment due to the difference in tension between the respective wire ropes. That is, the drum diameter on the side wound with the wire rope having the higher tension is made smaller, while the drum diameter on the side wound with the wire rope having the lower tension is made larger. By so doing, the imbalance between the moments of the forces imposed on the respective drums is corrected. Even if the hoisting accessory leans leftward or rightward, torques acting on the respective drums are canceled out. When each drum is conical, the relationship between the takeup amount and payout amount of the right and left wire ropes on the drum is constant, so that the tension ratio of the wire ropes is also constant at a predetermined position of the hoisting accessory. However, the tension ratio (tension difference) between the right and left wire ropes differs according to the ascending or descending position of the hoisting accessory. Merely forming the drum in a conical shape does not make it possible to cancel out torques acting on the drums in all areas in which the hoisting accessory moves.

SUMMARY OF THE INVENTION

The present invention has been accomplished to solve the above-described problems. It is an object of this invention to provide a crane apparatus designed to cancel out torques acting on a pair of drums in all areas in which a hoisting accessory moves, so that the capacity of a drive motor can be reduced.

A crane apparatus according to the present invention comprises:

- a body frame;
- a pair of drums rotatably mounted on the body frame;
- a hoisting accessory capable of attaching and detaching a load thereto and therefrom;

a pair of wire ropes having an end taken up by the drums, and having the other end connected to the hoisting accessory;

a traversing motor mounted on the body frame;

hoisting accessory traversing means for traversing the hoisting accessory by rotating the drums by driving of the traversing motor to take up or pay out the wire ropes;

speed change means for changing rotational speed of at least one of the drums; and control means for controlling the speed change means in a gear changing manner so that forces imposed on the drums by the wire ropes will be balanced.

According to this constitution, torques acting on the pair of drums are canceled out in all areas in which the hoisting accessory moves. As a result, the capacity of the traversing motor can be reduced. Furthermore, the hoisting accessory horizontally moves during traversal. Thus, the hoisting accessory can be traversed simply by driving the traversing motor, and the capacity of the hoisting/lowering motor can be reduced.

In the crane apparatus, it is desirable that when the driving output of the traversing motor is designated as P, the tensions of the respective wire ropes as $T_1$, and $T_2$, and the velocities of the respective wire ropes as $V_1$ and $V_2$, the control means sets the change gear ratio $\alpha=T_1/T_2$ of the speed change means such that the following equation will hold:

$$P=(\alpha T_1-T_2)(V_1/\alpha-V_2)/2=0$$

In the crane apparatus, it is also desirable that when the angles of the respective wire ropes to a horizontal line are designated as $\theta_1$ and $\theta_2$, and the weight of the hoisting accessory having the load suspended therefrom is designated as m, the tensions $T_1$ and $T_2$ of the respective wire ropes are calculated from the following equations:

$$T_1=mg\cdot\cos\theta_2/\sin(\theta_1+\theta_2)$$

$$T_2=mg\cdot\cos\theta_1/\sin(\theta_1+\theta_2)$$

In the crane apparatus, the speed change means may be composed of first speed change means provided on a first driving force transmission path from the traversing motor to one of the drums, and second speed change means provided on a second driving force transmission path from the traversing motor to the other drum, and the change gear ratio $\alpha$ may be achieved by the change gear ratio $\alpha_1$ of the first speed change means and the change gear ratio $\alpha_2$ of the second speed change means. By so doing, the change gear ratio of one speed change means can be set to be low, so that the apparatus can be downsized.

In the crane apparatus, the speed change means may be a continuously variable transmission. By so doing, a gear changing action during traversal of the hoisting accessory can be performed smoothly, whereby the hoisting accessory can be traversed stably.

In the crane apparatus, the speed change means may be provided on each of a first driving force transmission path from the traversing motor to one of the drums, and a second driving force transmission path from the traversing motor to the other drum. By so doing, a gear change range by each speed change means can be set to be narrow, so that the apparatus can be made compact and light-weight.

The crane apparatus may further include a hoisting/lowering motor mounted on the body frame, and hoisting accessory hoisting/lowering means for hoisting and lowering the hoisting accessory by rotating the drums by the driving of the hoisting/lowering motor to take up or pay out the wire ropes. Thus, the traversal and the hoisting or lowering of the hoisting accessory can be performed simultaneously to increase the work efficiency.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Embodiments of the present invention will now be described in detail with reference to the accompanying drawings.

Figure 1:
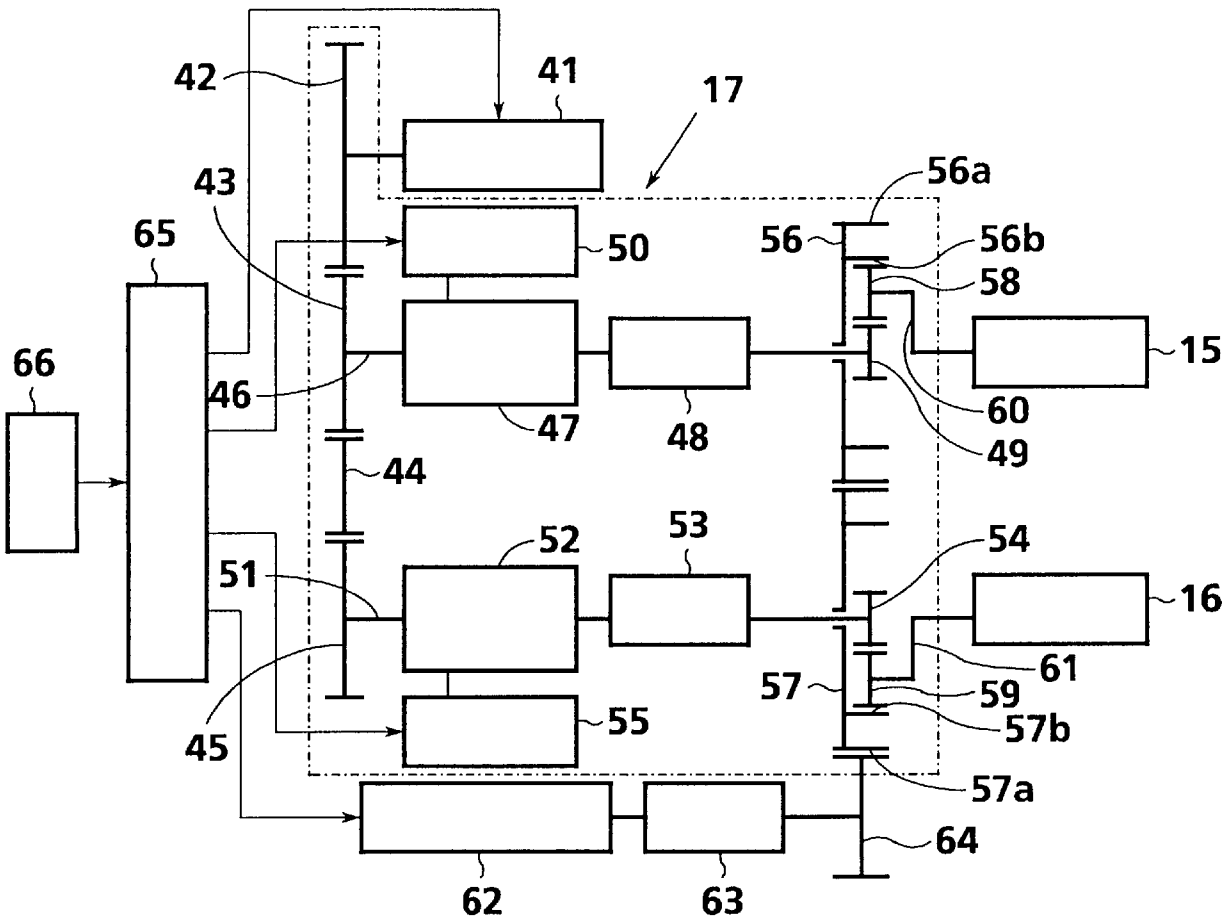
FIG. 1 is a block diagram of a crane apparatus according to a first embodiment of the present invention.
Figure 2:
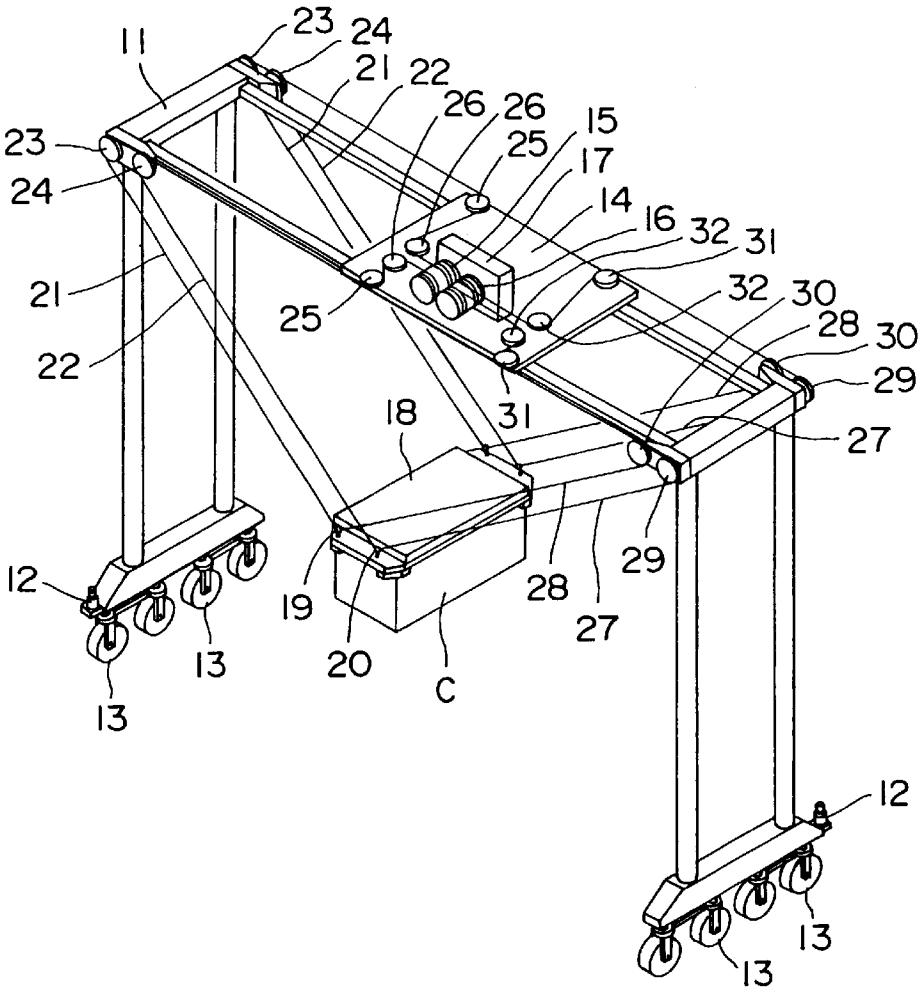
FIG. 2 is a schematic constitution drawing of the crane apparatus according to this embodiment.
Figure 3:
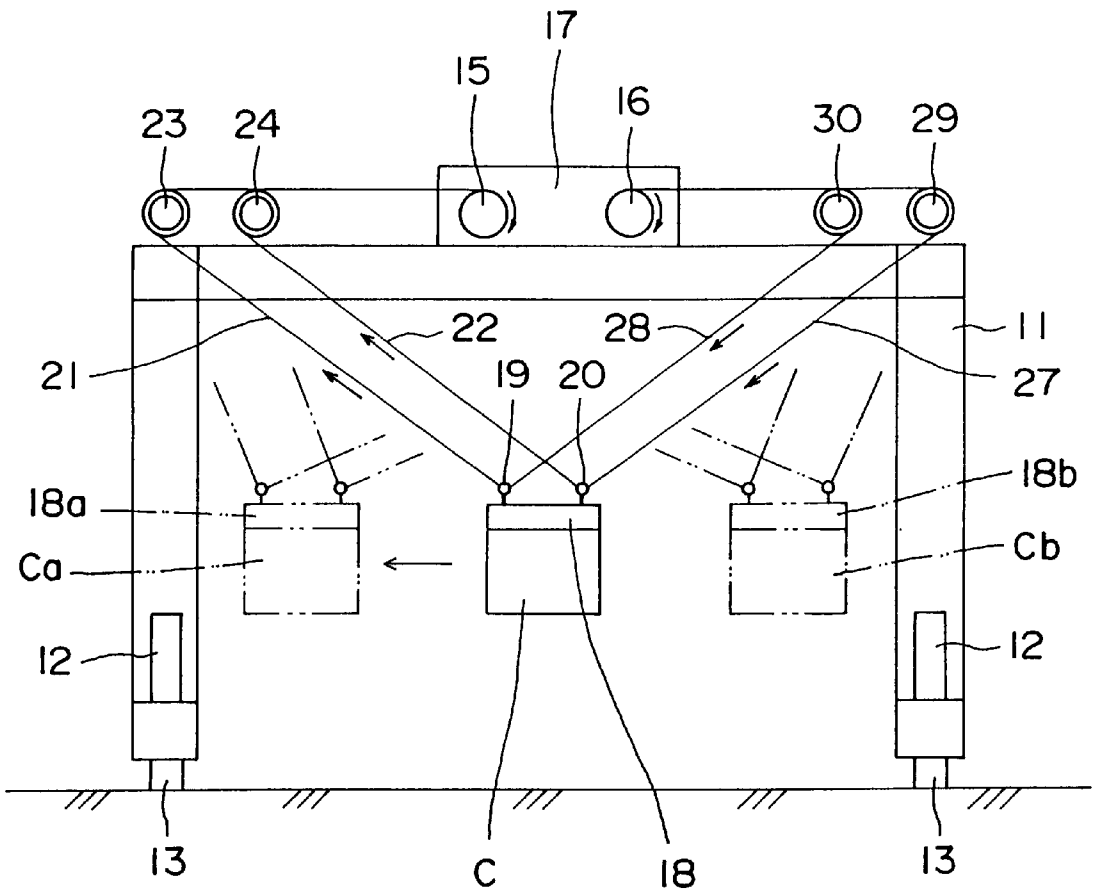
FIG. 3 is an operational explanation drawing of the crane apparatus according to this embodiment.

FIG. 1 is a block diagram of a crane apparatus according to a first embodiment of the present invention. FIG. 2 is a schematic constitution drawing of the crane apparatus according to this embodiment. FIG. 3 is an operational explanation drawing of the crane apparatus according to this embodiment.

In the crane apparatus of the present embodiment, as shown in FIGS. 2 and 3, a body frame 11 is shaped like a gate. To a lower portion of the body frame 11 on both sides thereof, a plurality of traveling wheels 13 are mounted which are rotationally driven by traveling motors 12. To an upper portion of the body frame 11, a support board 14 is fixed. On the support board 14, a rotational drive device 17 capable of normally and reversely rotating left and right rotating drums 15 and 16 as a pair is provided. A hoisting accessory 18 capable of holding a container C as a load has connecting portions 19 and 20 on left and right sides thereof. A pair of wire ropes 21 and 22 have an end connected to the connecting portions 19 and 20 by turnbuckles, and have the other end passed over left-hand sheaves 23 and 24 on the body frame 11 and then wound round the rotating drum 15 via sheaves 25 and 26. A pair of wire ropes 27 and 28 have an end connected to the connecting portions 19 and 20 by turnbuckles, and have the other end passed over right-hand sheaves 29 and 30 on the body frame 11 and then wound round the rotating drum 16 via sheaves 31 and 32. When the rotating drums 15 and 16 are rotated in opposite directions, either a hoisting motion or a lowering motion can be made. By rotating the rotating drums 15 and 16 in opposite directions to take up the wire ropes 21, 22 and the wire ropes 27, 28, the container C held by the hoisting accessory 18 can be hoisted. By rotating the rotating drums 15 and 16 in opposite directions to pay out the wire ropes 21, 22 and the wire ropes 27, 28, the container C held by the hoisting accessory 18 can be lowered. When the rotating drums 15 and 16 are rotated in the same direction, a traversing motion can be made. By rotating the rotating drums 15 and 16 in the same direction to take up the wire ropes 21, 22 and pay out the wire ropes 27, 28, the container C held by the hoisting accessory 18 can be traversed leftward. By rotating the rotating drums 15 and 16 in the same direction to pay out the wire ropes 21, 22 and take up the wire ropes 27, 28, the container C held by the hoisting accessory 18 can be traversed rightward.

The aforementioned rotational drive device 17 will be described. As shown in FIG. 1, a drive gear 42 secured to an output shaft of a traversing motor 41 is in mesh with a first gear 43. The first gear 43 is in mesh with a second gear 45 via an intermediate gear 44. The first gear 43 and the second gear 45 are of the same shape. A drive shaft 46 of the first gear 43 is connected to a first sun gear 49 via a continuously variable transmission 47 and a reduction gear 48. The continuously variable transmission 47 can be gear changed by a varying speed motor 50. A drive shaft 51 of the second gear 45 is connected to a second sun gear 54 via a continuously variable transmission 52 and a reduction gear 53. The continuously variable transmission 52 can be gear changed by a varying speed motor 55.

A first ring gear 56 and a second ring gear 57 mesh by external gears 56*a* and 57*a*. The first sun gear 49 meshes with an internal gear 56*b* of the first ring gear 56 via a planet gear 58. The second sun gear 54 meshes with an internal gear 57*b* of the second ring gear 57 via a planet gear 59. The planet gear 58 is connected to the rotating drum 15 via a carrier 60, while the planet gear 59 is connected to the rotating drum 16 via a carrier 61. The first sun gear 49, the planet gear 58 and the first ring gear 56 constitute a first planet gear mechanism. The second sun gear 54, the planet gear 59 and the second ring gear 57 constitute a second planet gear mechanism. The drive gear 42, the first gear 43, the intermediate gear 44, the second gear 45, the continuously variable transmissions 47 and 52, the reduction gears 48 and 53, and the respective planet gear mechanisms constitute hoisting accessory traversing means. A first driving force transmission path ranges from the first gear 43 to the rotating drum 15, and a second driving force transmission path ranges from the second gear 45 to the rotating drum 16.

An output shaft of a hoisting/lowering motor 62 is secured to a drive gear 64 via a reduction gear 63, and the drive gear 64 is in mesh with the external gear 57*a* of the second ring gear 57.

The traversing motor 41 and the hoisting/lowering motor 62 are connected to a control device 65, which determines stoppage of driving and sets the direction of rotation on the basis of data entered from an input section 66. The varying speed motor 50 for the continuously variable transmission 47, and the varying speed motor 55 for the continuously variable transmission 52 are also connected to the control device 65, which sets the change gear ratios on the basis of data entered from the input section 66.

When the traversing motor 41 is driven by the control device 65, a driving force is transmitted to the planet gear 58 via the drive gear 42, first gear 43, continuously variable transmission 47, reduction gear 48, and first sun gear 49. Also, the driving force is transmitted from the first gear 43 to the planet gear 59 via the intermediate gear 44, second gear 45, continuously variable transmission 52, reduction gear 53, and second sun gear 54. These transmitted driving forces rotate the drums 15 and 16 in the same direction, whereupon the hoisting accessory 18 (container C) can be traversed. When the hoisting/lowering motor 62 is driven by the control device 65, on the other hand, its driving force is transmitted to the second ring gear 57 via the reduction gear 63 and drive gear 64. The driving force is also transmitted to the first ring gear 56 via the second ring gear 57. Thus, the drums 15 and 16 are rotated in opposite directions, whereby the hoisting accessory 18 (container C) can be hoisted or lowered.

In the crane apparatus of the present embodiment, moreover, the control device 65 controls the continuously variable transmissions 47 and 52 to be gear changed, by means of the varying speed motors 50 and 55 so that the forces imposed on the drums 15 and 16 by the pair of wire ropes 21 and 22 and the pair of wire ropes 27 and 28 will be balanced. In detail, when the hoisting accessory 18 (container C) is situated in a central portion in the right-and-left direction of the body frame 11, as shown in FIG. 3, the lengths of the wire ropes 21, 22 from the connecting portions 19, 20 of the hoisting accessory 18 to the left-hand sheaves 23, 24 are the same as the lengths of the wire ropes 27, 28 from the connecting portions 19, 20 of the hoisting accessory 18 to the right-hand sheaves 29, 30. Thus, tensions acting on the wire ropes 21, 22 and 27, 28, namely, reaction forces acting on the drums 15, 16 are the same. When the hoisting accessory 18 is moved leftward or rightward relative to the body frame 11, the lengths of the wire ropes 21, 22 and 27, 28 vary. Thus, a difference in tension occurs, causing a difference between the reaction forces acting on the drums 15 and 16. In the present embodiment, therefore, the reaction forces acting on the drums 15 and 16 are balanced by changing the reduction gear ratios of the continuously variable transmissions 47 and 52 in response to these reaction forces. By so balancing, the driving force of the traversing motor 41 may be made close to zero; namely, unless there is the sliding resistance of the wire ropes or the rotating resistance of the sheaves, the hoisting accessory 18 can be traversed under its inertial force alone.

The gear change control of the continuously variable transmissions 47 and 52 will be described concretely. A driving output, P, of the traversing motor 41 during traversal of the hoisting accessory 18 can be obtained from the following equation:

$$P=(T_1-T_2)(V_1-V_2)/2$$

where $T_1$ is the tension of each of the wire ropes 21 and 22, $T_2$ is the tension of each of the wire ropes 27 and 28, $V_1$ is the velocity of each of the wire ropes 21 and 22, and $V_2$ is the velocity of each of the wire ropes 27 and 28. The velocities $V_1$ and $V_2$ of the wire ropes 21, 22 and 27, 28 are set as different velocities which are different in direction between the takeup side and the payout side, i.e., as absolute values.

Operational control in the crane apparatus is performed by entering a target position of a destination with respect to a reference position on a two-dimensional coordinate plane. The control device 65 sets a takeup amount and a payout amount of the wire ropes 21, 22 and 27, 28 for the range from the reference position to the target position. Based on the takeup amount and the payout amount of the wire ropes 21, 22 and 27, 28, the actual takeup length and payout length (the length $L_1$ of the wire ropes 21, 22 from the connecting portions 19, 20 of the hoisting accessory 18 to the left-hand sheaves 23, 24, and the length $L_2$ of the wire ropes 27, 28 from the connecting portions 19, 20 of the hoisting accessory 18 to the right-hand sheaves 29, 30) are determined. The angle $\theta_1$ of the wire ropes 21, 22 to a horizontal line, and the angle $\theta_2$ of the wire ropes 27, 28 to the horizontal line are also determined by the takeup amount and payout amount. The tensions $T_1$ and $T_2$ of the wire ropes 21, 22 and 27, 28 are calculated from the following equations:

$$T_1=mg\cdot\cos\theta_2/\sin(\theta_1+\theta_2)$$

$$T_2=mg\cdot\cos\theta_1/\sin(\theta_1+\theta_2)$$

where m is the total weight of the hoisting accessory 18 and the container C. The weight m can be measured with a weight sensor provided on the hoisting accessory 18.

When the hoisting accessory 18 (container C) is traversed leftward from a central position in the body frame 11 as shown in FIG. 3, for example, the rotating drum 15 requires a driving force (positive power) for taking up the wire ropes 21, 22 at a predetermined velocity, while the rotating drum 16 requires a braking force (negative power) for preventing a rapid payout, because it has to pay out the wire ropes 27, 28 at a predetermined velocity. If the driving force and the braking force are balanced, namely, if the rope tensions $T_1$ and $T_2$ are equal in the equation for finding the driving output, P, of the traversing motor 41, P will be zero, so that the driving output of the traversing motor 41 will basically be unnecessary. Actually, as the traversing position of the hoisting accessory 18 (container C) moves, the reaction forces exerted on the rotating drums 15, 16 (i.e., rope tensions $T_1$, $T_2$) vary over time. Thus, in order that the reaction forces on the rotating drums 15, 16 will equal, the reduction gear ratio in the driving force transmission path from the first gear 43 to the rotating drum 15, and the reduction gear ratio in the driving force transmission path from the second gear 45 to the rotating drum 16 are changed from time to time. That is, at the position of the hoisting accessory 18*a* (container Ca) in FIG. 3, the reaction force on the rotating drum 15 (i.e., the rope tension $T_1$ of the wire ropes 21, 22) increases. To rotate the rotating drum 15 more slowly, therefore, the continuously variable transmission 47 is gear changed. On the other hand, the reaction force on the rotating drum 16 (i.e., the rope tension $T_2$ of the wire ropes 27, 28) decreases. To rotate the rotating drum 16 more rapidly, therefore, the continuously variable transmission 52 is gear changed. The reduction gear ratio on this occasion will be $\alpha=T_1/T_2$. The driving output P of the traversing motor 41 in this situation will be given by:

$$P=(\alpha T_1-T_2)(V_1/\alpha-V_2)/2=0$$

The reduction gear ratio $\alpha$ is achieved by the two continuously variable transmissions 47 and 52.

In the crane apparatus of the present embodiment, as described above, the change gear ratio of the two continuously variable transmissions 47 and 52 is set at the predetermined value $\alpha$ in accordance with the traversing position of the hoisting accessory 18 (container C) to balance the reaction forces acting on the drums 15 and 16 with each other. Unless there is sliding resistance of the wire ropes or rotating resistance of the sheaves, the hoisting accessory 18 can be traversed under its inertial force alone, without the driving output of the traversing motor 41 being required. Furthermore, the rotational speed ratio of the rotating drums 15 and 16, i.e., the takeup amount and payout amount of the wire ropes 21, 22 and 27, 28, proportionally changes with the traversing position of the hoisting accessory 18 (container C) Thus, the hoisting accessory 18 (container C) can move horizontally. Only the driving output of the traversing motor 41 is necessary, and the driving output of the hoisting/lowering motor 62 becomes unnecessary.

In the foregoing embodiment, the continuously variable transmissions 47, 52 have been provided between the gears 43, 45 and the reduction gears 48, 53. However, the continuously variable transmissions 47, 52 may be provided anywhere in the first driving force transmission path from the first gear 43 to the rotating drum 15, and in the second driving force transmission path from the second gear 45 to the rotating drum 16. Alternatively, one continuously variable transmission may be provided in only one of the driving force transmission paths, if the single continuously variable transmission can achieve the reduction gear ratio $\alpha$. In place of the continuously variable transmission, a transmission whose change gear ratio can be varied stepwise may be used.

The reaction forces on the rotating drums 15 and 16 have been determined based on the tensions $T_1$ and $T_2$ of the wire ropes 21 and 22, but may be determined using a torque sensor provided on the rotating drums 15 and 16.

Furthermore, the above-mentioned crane apparatus of the present embodiment has been constituted such that the wire ropes 21 and 22 have an end connected to the connecting portions 19 and 20 of the hoisting accessory 18, and have the other end taken up on the rotating drum 15 via the sheaves 23, 24, 25 and 26. Whereas the wire ropes 27 and 28 have an end connected to the connecting portions 19 and 20 of the hoisting accessory 18, and have the other end taken up on the rotating drum 16 via the sheaves 29, 30, 31 and 32. However, the method of looping the wire ropes, the method of connecting the wire ropes to the hoisting accessory, the positions of mounting of the sheaves, and the position of installation of the traversing motor on the body frame are not restricted to the present embodiment, as long as the hoisting accessory is traversed by rotating the pair of drums by the driving of the traversing motor to take up or pay out the wire ropes.

In the foregoing respective embodiments, the rotating drums 15, 16, the wire ropes 21, 22, and the wire ropes 27, 28 have been constituted as a pair composed of right and left members. However, they may be provided as a plurality of pairs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A crane apparatus comprising:

a body frame;

a pair of drums rotatably mounted on the body frame;

a hoisting accessory capable of attaching and detaching a load thereto and therefrom;

a pair of wire ropes having an end taken up by the drums, and having the other end connected to the hoisting accessory;

a traversing motor mounted on the body frame;

hoisting accessory traversing means for traversing the hoisting accessory by rotating the drums by driving of the traversing motor to take up or pay out the wire ropes;

speed change means for changing rotational speed of at least one of the drums; and control means for controlling the speed change means in a gear changing manner so that forces imposed on the drums by the wire ropes will be balanced.

2. The crane apparatus of claim 1, wherein when a driving output of the traversing motor is designated as P, tensions of the respective wire ropes as $T_1$ and $T_2$, and velocities of the respective wire ropes as $V_1$ and $V_2$, the control means sets a change gear ratio $\alpha=T_1/T_2$ of the speed change means such that the following equation will hold:

$$P=(\alpha T_1-T_2)\ (V_1\alpha-V_2)/2=0.$$

3. The crane apparatus of claim 2, wherein when angles of the respective wire ropes to a horizontal line are designated as $\theta_1$ and $\theta_2$, and a weight of the hoisting accessory having the load suspended therefrom is designated as m, the tensions $T_1$ and $T_2$ of the respective wire ropes are calculated from the following equations:

$$T_1 = mg \cdot \cos\theta_2 / \sin(\theta_1 + \theta_2)$$

$$T_2 = mg \cdot \cos\theta_1 / \sin(\theta_1 + \theta_2).$$

4. The crane apparatus of claim 2, wherein the speed change means is composed of first speed change means provided on a first driving force transmission path from the traversing motor to one of the drums, and second speed change means provided on a second driving force transmission path from the traversing motor to the other drum, and the change gear ratio $\alpha$ is achieved by a change gear ratio $\alpha_1$ of the first speed change means and a change gear ratio $\alpha_2$ of the second speed change means.

5. The crane apparatus of claim 1, wherein the speed change means is a continuously variable transmission.

6. The crane apparatus of claim 1, wherein the speed change means is provided on each of a first driving force transmission path from the traversing motor to one of the drums, and a second driving force transmission path from the traversing motor to the other drum.

7. The crane apparatus of claim 1, further including:

a hoisting/lowering motor mounted on the body frame; and hoisting accessory hoisting/lowering means for hoisting and lowering the hoisting accessory by rotating the drums by driving of the hoisting/lowering motor to take up or pay out the wire ropes.

* * * * *